United States Patent [19]

Townsend et al.

[11] 4,020,876

[45] May 3, 1977

[54] TRIAXIAL WEAVING MACHINE WITH FLEXIBLE PASSAGEWAYS FOR GUIDING WARP STRANDS

[75] Inventors: Franklin L. Townsend; Robert L. Govig, both of Rockford, Ill.

[73] Assignee: Barber-Colman Company, Rockford, Ill.

[22] Filed: Jan. 29, 1976

[21] Appl. No.: 653,371

[52] U.S. Cl. ..... 139/97; 139/DIG. 1

[51] Int. Cl.[2] ..... D03D 41/00

[58] Field of Search ..... 139/1, 11, 13, DIG. 1, 139/35, 48, 97

[56] References Cited

UNITED STATES PATENTS

| | | | |
|---|---|---|---|
| 550,068 | 11/1895 | Crompton | 139/DIG. 1 |
| 1,184,790 | 5/1916 | Trautvetter | 139/DIG. 1 |
| 2,223,317 | 11/1940 | Ewing | 139/11 |

FOREIGN PATENTS OR APPLICATIONS

| | | | |
|---|---|---|---|
| 1,358,056 | 3/1964 | France | 139/DIG. 1 |
| 14,098 | 1892 | United Kingdom | 139/DIG. 1 |

*Primary Examiner*—Henry S. Jaudon

[57] ABSTRACT

A weaving machine for making triaxial fabrics which has a plurality of heddles arranged in weftwise rows for guiding warp strands, an arrangement for shifting warp strands weftwise during weaving, and a creel for supplying warp strands and for rotating in timed relation with the weftwise shifting of the warp strands. In accordance with the present invention, structure is provided for guiding warp strands passing from the creel to the heddles along substantially constant length paths and takes the particular form of a plurality of elongate flexible guides defining passageways through which warp strands extend, with entry end portions of the guides being arranged generally circularly and mounted for movcment in timed relation with rotation of the creel and with exit end portions arranged in weftwise rows substantially aligned with the weftwise rows of heddles and mounted for movement in timed relation with weftwise shifting of the warp strands.

15 Claims, 5 Drawing Figures

TRIAXIAL WEAVING MACHINE WITH FLEXIBLE PASSAGEWAYS FOR GUIDING WARP STRANDS

Triaxial fabrics and weaving machines for making such fabrics have been known for some time. Recent further development of such fabrics and weaving machines, as exemplified by Dow U.S. Pat. No. RE 28,155 and Dow et al U.S. Pat. No. 3,799,209, has revived interest in such fabrics and weaving machines due to the desirable properties of such fabrics for certain end uses. With revived interest in development of such weaving machines, consideration has been given to optimizing productivity of such machines and, in that connection, to efficient use of floor space and facilitation of ready servicing.

In seeking such ends, it has been proposed that warp strands used in making triaxial fabrics be supplied to the weaving instrumentalities of a triaxial weaving machine from a creel supported for rotation about a vertical axis in timed relation with weftwise shifting of warp strands. Where such a structural organization is adopted for a triaxial weaving machine, it is necessary to assure that warp strands are guided from the creel to the weaving instrumentalities along substantially constant length paths.

It is an object of the present invention to improve warp strand guide arrangements for triaxial fabric weaving machines by facilitating a more compact arrangement of such guide means. In realizing this object of the present invention, structure is provided for passing warp strands through a plurality of elongate flexible warp strand guides defining passageways, each of which has an entry end moving in timed relation with rotation of a rotating creel and an exit end moving in timed relation with weftwise shifting of warp strands. Warp strands enter the guide passageways generally in a circular array and exit the passageways arrayed generally in two sheets for manipulation by weaving instrumentalities of the weaving machine. Flexing of the guides maintains constant length paths for the warp strands irrespective of the changing configurations of those paths necessitated for coordination of the relative movements and changing arrays of the warp strands.

Some of the objects of the invention having been stated, other objects will appear as the description proceeds, when taken in connection with the accompanying drawings, in which.

While the present invention will be described more fully hereinafter with reference to the accompanying drawings, it is to be understood at the outset that it is contemplated that persons skilled in the art of weaving machines may be able to make other and further adaptations of the principles to be hereinafter described. Accordingly, the description which here follows is to be understood as a broad and enabling disclosure of this invention, rather than being limiting and restrictive on the scope of this invention.

A weaving machine for making triaxial fabrics constructed in accordance with the present invention preferably has a generally upright orientation, with a plurality of main frame members. Three of the main frame members are indicated at 20, 21, 22 in FIG. 2.

Figure 1:
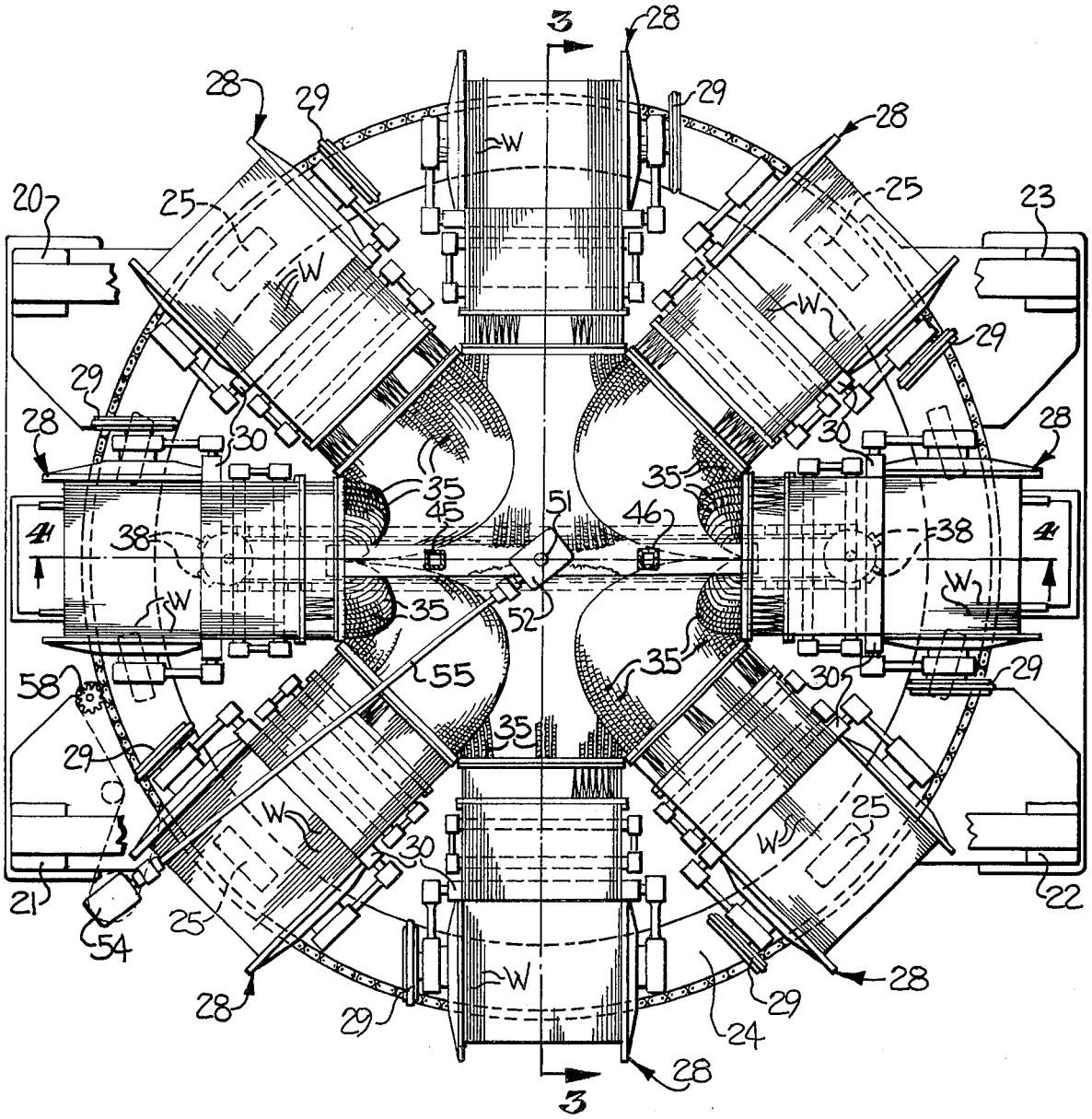
FIG. 1 is a plan view of a weaving machine for making triaxial fabrics and incorporating an improved warp strand guide arrangement in accordance with this invention.
Figure 2:
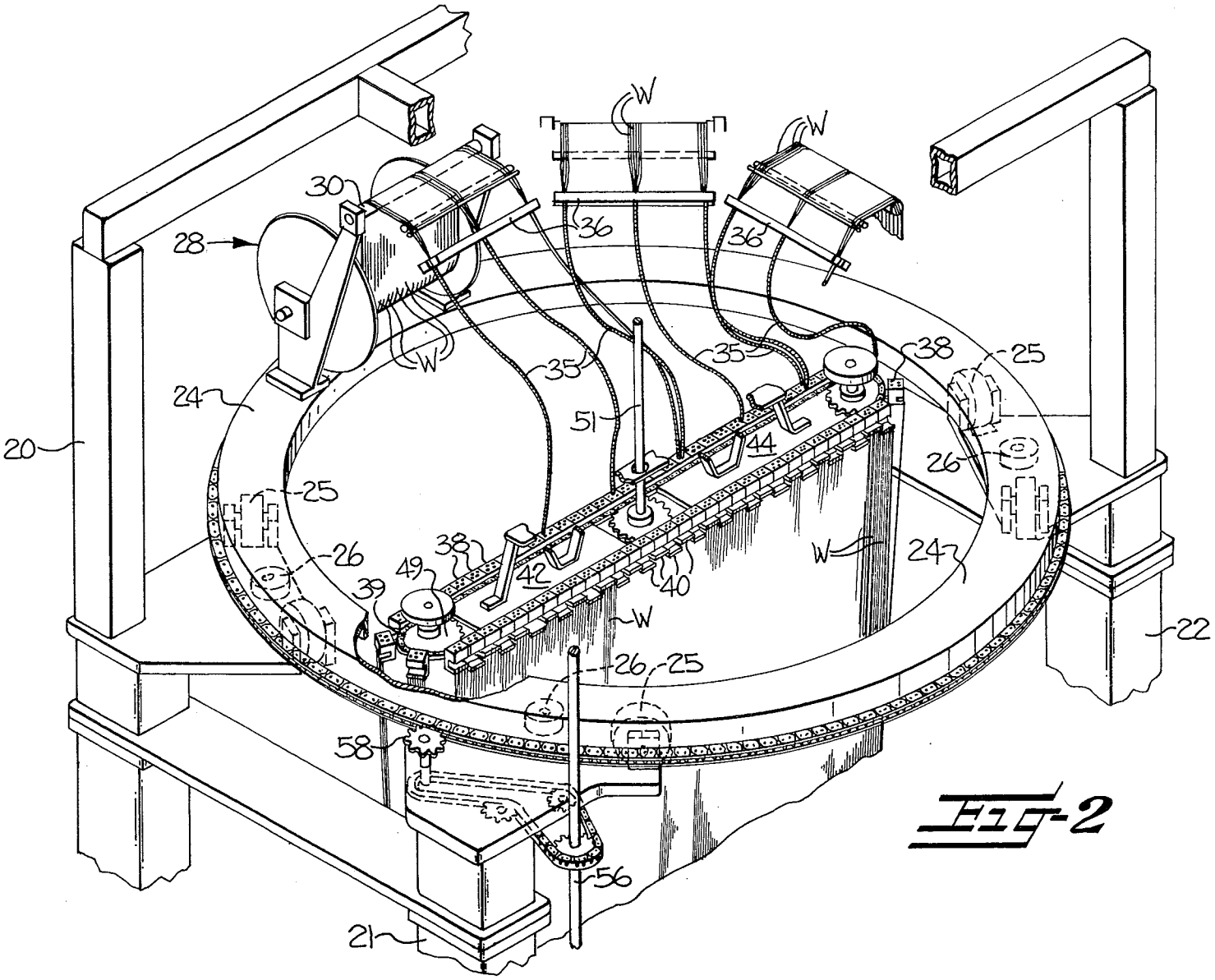
FIG. 2 is a perspective view of portions of the weaving machine of FIG. 1, partly in section and partly broken away, illustrating the elements of the warp strand guide arrangement in accordance with this invention.
Figure 3:
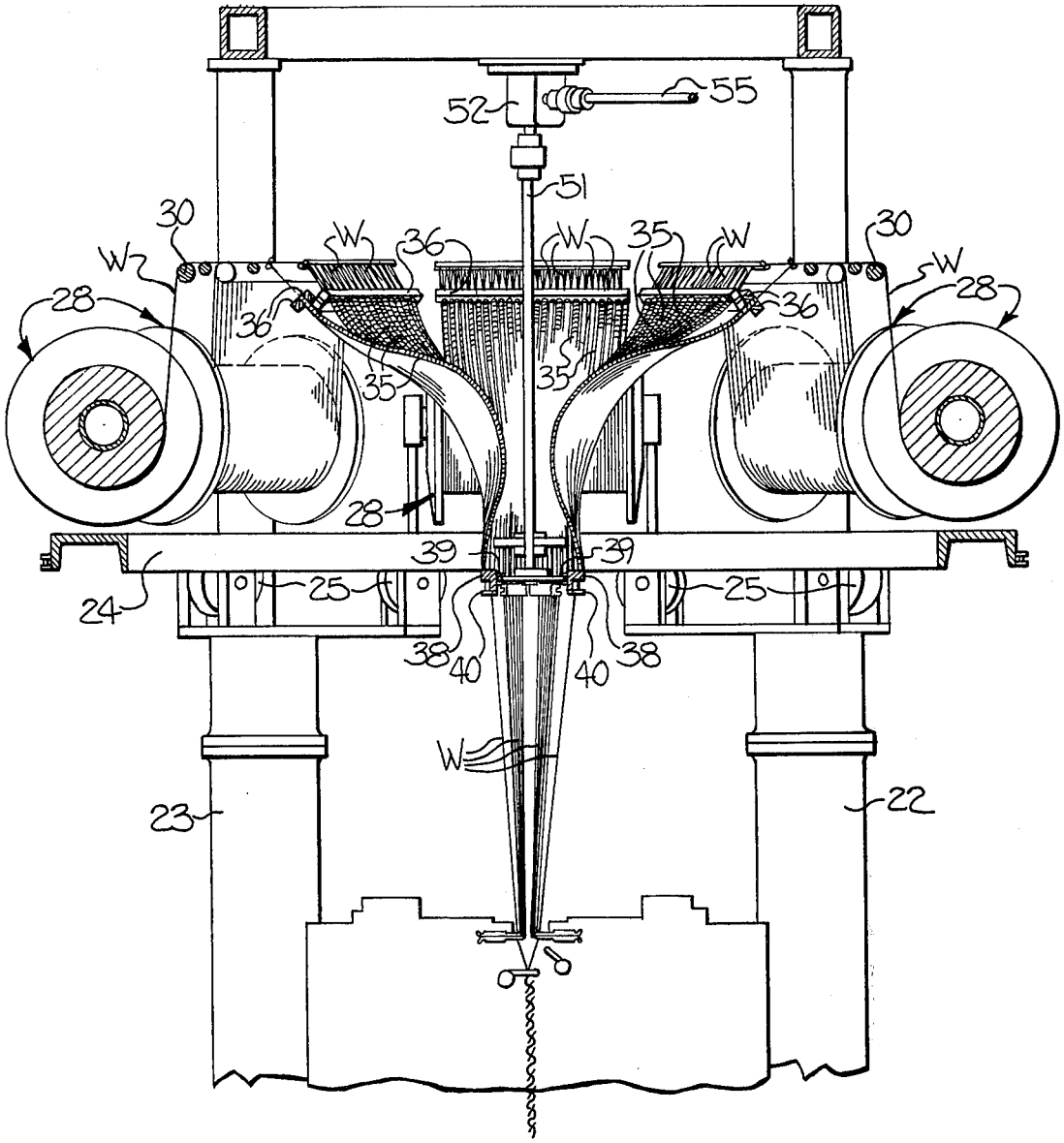
FIG. 3 is an elevation view, partly in section, taken substantially along a line 3—3 in FIG. 1.
Figure 4:
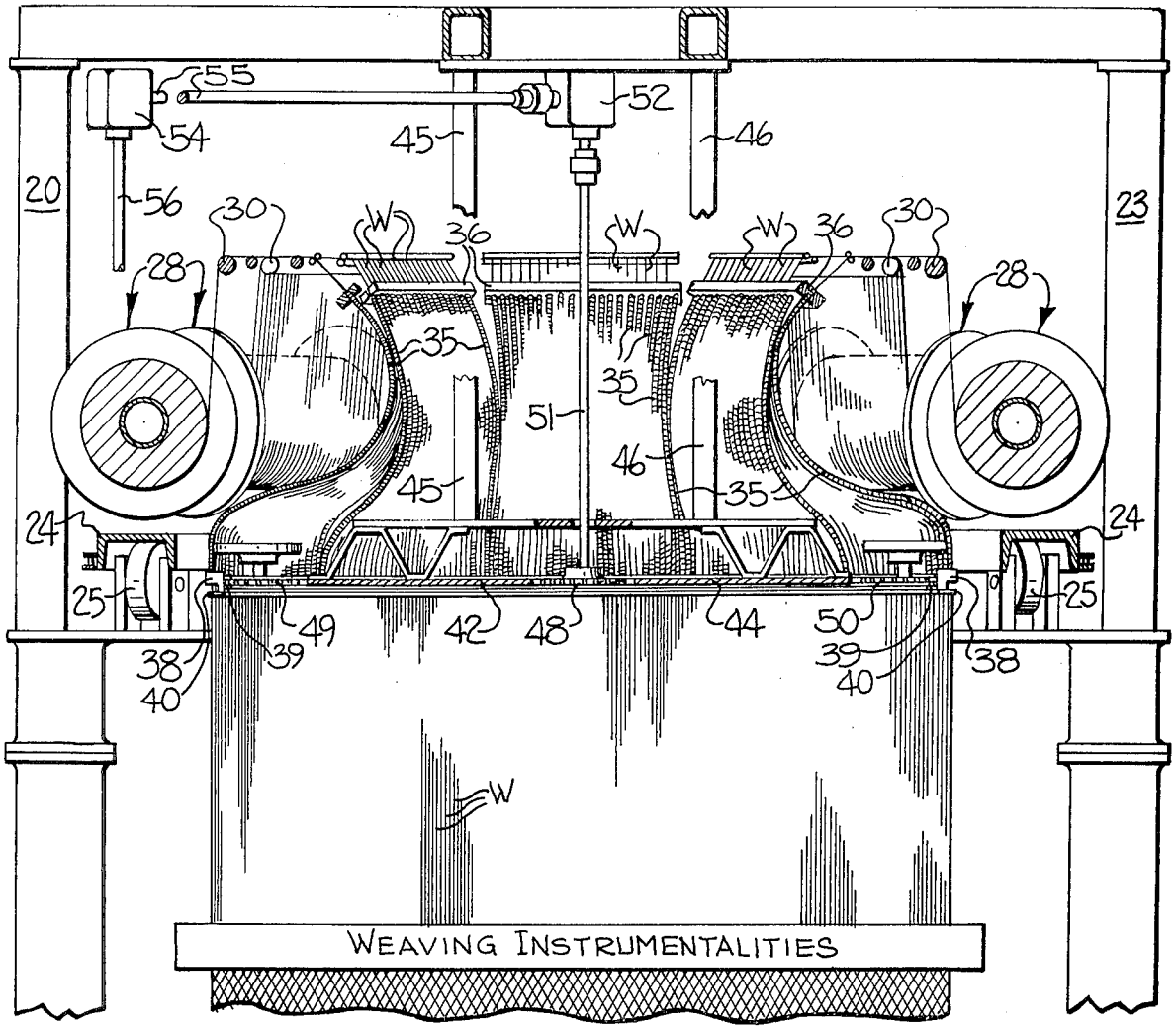
FIG. 4 is a view similar to FIG. 3, taken substantially along a line 4—4 in FIG. 1.

Creel means for the weaving machine include a ring member 24 supported from the main frame members of the weaving machine for rotation about a vertically disposed axis. In the form illustrated, the ring member 24 has a generally channel shaped cross-section (FIGS. 3 and 4) and is supported by a plurality of horizontal rollers 25 mounted from the main frame members of the weaving machine. The ring member 24 is guided in its rotational movement by a plurality of vertical rollers 26. In order to supply warp strands for the weaving of triaxial fabrics by the weaving machine in accordance with the present invention, a plurality of warp strand beams are mounted on the ring member 24. Each beam is mounted for rotation about a corresponding axis and supplies a corresponding group of warp strands. One beam is generally indicated at 28 in FIG. 2 and each of the plurality of beams shown in FIGS. 1, 3 and 4 is similarly designated. The details of construction of a warp beam 28 and associated mechanism may be determined by persons skilled in the art of weaving textile fabrics and, accordingly, will not be here described in great detail. It is noted that each warp beam may be driven by a corresponding let-off motor indicated at 29 and that warp strands indicated at W delivered from the warp beams 28 may pass over corresponding whip rolls indicated at 30.

In the triaxial weaving machine of this invention, warp strands supplied by the creel are directed to weaving instrumentalities arranged beneath the creel for manipulation with weft yarns in forming triaxial fabrics. Such weaving instrumentalities are indicated generally in block diagram form in FIG. 4 and may take forms which vary in specific detail. By way of example, certain weaving instrumentalities for forming triaxial fabrics are shown in Dow et al U.S. Pat. No. 3,799,209 mentioned hereinabove. Other instrumentalities are shown, by way of example, in co-pending United States Patent applications Ser. Nos. 582,246 filed May 30, 1975, now U.S. Pat. No. 3,985,160; 603,657 filed Aug. 11, 1975; and 603,756 filed Aug. 11, 1975 and all owned in common with the present invention. To the extent that the disclosures of such prior patents and co-pending applications are required for a full and complete understanding of the present invention, such disclosures are hereby incorporated by reference into this description.

In operation of the weaving instrumentalities of the triaxial weaving machine of the present invention, the warp strands are guided into an array of two sheets of generally parallel warp yarns. A plurality of elongate heddles (FIG. 3) are arranged in weftwise rows for guiding the warp strands and cooperate with means which longitudinally move the heddles so as to form the warp strands guided thereby into warp sheds, into which wefts are inserted. The warp strands are shifted weftwise during weaving, with the direction of movement of warp strands in one of the sheets being opposite to that of warp strands in the other of the sheets. As warp strands reach an edge of each of the sheets, they are transferred to the adjacent edge of the other sheet, to continue weftwise movement. Preferably, and in acccordance with certain of the aforementioned related applications, the warp strands are guidingly received in warp strand guide openings extending through nose portions of the heddles and are moved weftwise by shifting of the heddles. Triaxial fabric woven by such interengagement of warp strands and wefts is suitably taken up in a roll.

As will be appreciated, weftwise displacement of warp strands and rotation of the creel in timed relation with such weftwise shifting would give rise to differences in the length of the warp strand path from the corresponding beam 28 to the weaving instrumentalities were it not for the provision of means for guiding the warp strands along substantially constant length paths irrespective of the weftwise position of the warp strands. Such a potential differential in warp strand paths will be understood to arise from the circular array of the beams 28 (FIG. 1) and the warp strand array of two sheets of generally parallel strands at the weaving instrumentality location (FIGS. 2 through 4).

Figure 5:
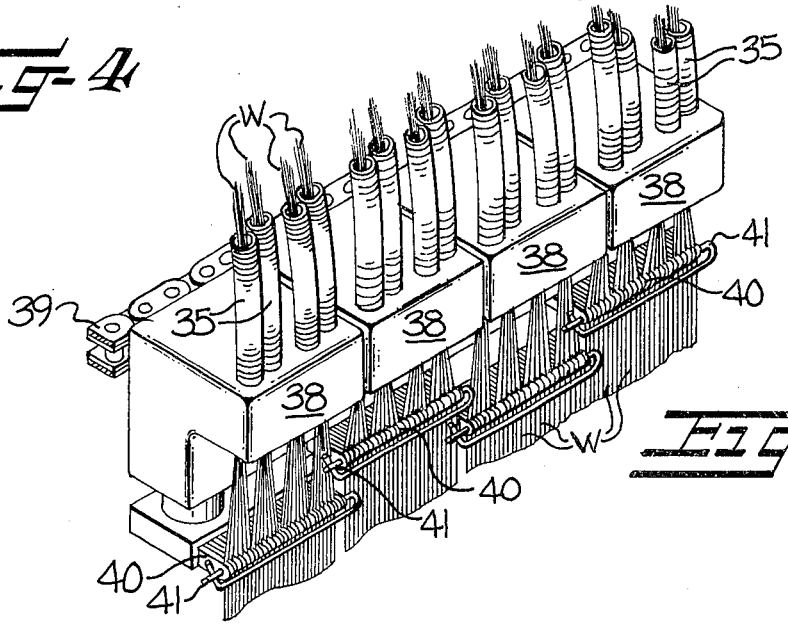
FIG. 5 is an enlarged perspective view of the exit end portions of flexible guides as shown in FIGS. 3 and 4.

In accordance with the present invention, warp strands passing from the creel to the heddles of the weaving instrumentalities are guided along substantially constant length paths by the provision of a plurality of elongate flexible warp strand guides preferably defining passageways through which the warp strands extend. Certain individual guides are visible in FIGS. 2 and 5 and are there indicated at 35. As will be understood from FIGS. 1, 3 and 4 the plurality of guides 35 (when fully illustrated) are such that clear distinction of individual guides 35 is not readily possible and for this reason only certain guides are illustrated in FIGS. 2 and 5.

Preferably, the guides 35 define passageways formed by abutting coils of tightly wound, helically extending spring wire, of the sort known to form a component of a flexible linear motion transmitting device known to persons skilled in the mechanical arts as a Bowden wire. Each guide 35 has a length greater than the longest straight line distance between the positions to be taken by the entry and exit end portions thereof during operation of the weaving machine. As persons familiar with such devices will recognize, it is a characteristic of such tightly wound helically extending spring wires to assume whatever bowed or curvilinear configuration may be required in order to accommodate relative displacement of opposite end portions thereof. Further, while in such curved or bowed condition, the tightly wound, helically extending spring wires maintain a substantially constant length path between the opposite end portions. As a result, the guides serve as tubular guides encircling or enclosing warp strands which pass therethrough. Other tubular materials possibly suitable for the present invention will be identifiable by skilled designers learning of this invention.

In the arrangement of the present invention, advantage is taken of this characteristic of such an elongate guide 35 in order to assure that warp strands passing from the creel means to heddles are guided downwardly along substantially constant length paths. More particularly, the entry end portions of the guides 35 are arranged generally circularly and mounted for movement in timed relation with rotation of the creel means, while exit end portions of the guides are arranged in weftwise rows substantially aligned with the weftwise rows of heddles and mounted for movement in timed relation with weftwise shifting of the warp strands.

Referring now more particularly to upper end portions of the guides 35, such entry end portions are preferably received within mounting bars generally indicated at 36, in spaced relation with corresponding whip rolls 30. Each mounting bar 36 receives entry end portions of a number of guides 35 sufficient to accommodate the warp strands supplied from a corresponding beam 28, and extends parallel to the rotational axis of the corresponding beam. In certain operating embodiments of this invention, a plurality of warp strands pass through each guide 35, such as five warp strands per passageway. Preferably, the mounting bars 36 for the entry portions of the passageways 35 are supported from the ring member 24 of the rotating creel, so as to move with the corresponding beams 28.

The guides 35 have the exit end portions thereof grouped and retained in mounting means in the form of block members 38 (most readily visible in FIG. 5) which are secured to an endless flexible drive member such as a chain 39. Each block member 38 receives the exit end portions of a plurality of guides 35 (in the embodiment illustrated in FIG. 5, four guides), less than the total number of guides required to accommodate the warp strands of a particular corresponding beam 28. The block members 38 preferably have warp strand combs 40 disposed adjacent the exit portions of the guides 35, for separating the warp strands issuing therefrom one from another. Retention of each warp strand between a corresponding pair of teeth of a comb 40 is assured by a pin guard 41 (FIG. 5).

The block members 38 are moved about a closed path of travel by the cooperation of the chain 39 with bladelike members 42, 44 (FIG. 2) which are stationarily supported by a superstructure including depending arms 45, 46 supported from the main frame members 21, 22 (FIG 4). By means of a drive sprocket 48 and idler sprockets 49, 50, the chain 39 and block members 38 are driven in movement about the closed path of travel in timed relation to weftwise shifting of warp strands and rotation of the creel. Such motion is transmitted to the drive sprocket 48 by a vertically extending shaft 51, which is in turn driven by angle transmissions 52, 54, a horizontal jack shaft 55, a vertical jack shaft 56, and a power train including a sprocket 58 operatively engaging the ring member 24 of the rotating creel (FIGS. 1 through 4).

As will be appreciated, each of the guides 35 maintains a substantially constant length path between the entry and exit end portions thereof, irrespective of the relative weftwise position of those portions. Such maintenance of a substantially constant length path involves flexure of the guides 35 into varying curved configurations, as is readily visible in FIGS. 1 through 4 of the accompanying drawings.

In the drawings and specification, there has been set forth a preferred embodiment of the invention, and although specific terms are employed, they are used in a generic and descriptive sense only and not for purposes of limitation.

That which is claimed is:

1. In a weaving machine for making triaxial fabrics and having a plurality of elongated heddles arranged in weftwise rows for guiding warp strands, means for shifting the warp strands weftwise during weaving, creel means for supplying warp strands for weaving and mounting for rotation in timed relation with weftwise shifting of the warp strands, and means for guiding warp strands passing from said creel means to said heddles along substantially constant length paths, the improvement wherein said warp strand guiding means comprises a plurality of elongate flexible warp strand guides for guiding the warp strands along their path of travel from said creel means to said heddles, said elongate guides having entry end portions mounted for movement in timed relation with rotation of said creel means and having exit end portions arranged in weftwise rows substantially aligned with the weftwise rows of heddles and mounted for movement in timed relation with weftwise shifting of the warp strands.

2. A weaving machine according to claim 1 wherein said creel means is mounted for rotation about a vertical axis, said heddles are arranged beneath said creel means, and said elongate guides extend downwardly along curvilinear paths.

3. A weaving machine according to claim 1 wherein the number of said elongate guides is less than the number of warp strands and each of said elongate guides is adapted for guiding a plurality of warp strands.

4. A weaving machine according to claim 1 wherein said warp strand guiding means further comprises means for mounting said exit end portions of said elongate guides for movement about a closed path of travel substantially parallel to said rows of heddles, and drive means for moving said mounting means about said closed path of travel in timed relation with weftwise shifting of the warp strands.

5. A weaving machine according to claim 4 wherein said drive means comprises means connecting said mounting means together in an endless, flexible loop extending along said closed path of travel.

6. A weaving machine according to claim 4 wherein said mounting means comprises a plurality of block members each of which mounts exit end portions of a corresponding plurality of elongate guides.

7. A weaving machine according to claim 1 wherein said creel means comprises a plurality of beam means each mounted for rotation about a predetermined axis for supplying a corresponding group of warp strands and further wherein said warp strand guiding means further comprises a plurality of entry end mounting bar means each extending substantially parallel to the rotational axis of a corresponding one of said beam means, each said bar means engaging said entry end portions of a corresponding plurality of said elongate guides for positioning the same to receive a corresponding group of warp strands.

8. In a weaving machine for making triaxial farbics and having a plurality of elongate heddles arranged in weftwise rows for guiding warp strands, means for shifting the warp strands weftwise during weaving, creel means for supplying warp strands for weaving and mounted for rotation about a generally vertical axis in timed relation with weftwise shifting of the warp strands, and means for guiding warp strands passing from said creel means to said heddles along substantially constant length paths, the improvement wherein said warp strand guiding means comprises a plurality of elongate flexible warp strand guides for defining passageways through which the warp strands extend, said passageways having entry end portions mounted for movement in timed relation with rotation of said creel means and having exit end portions arranged in weftwise rows substantially aligned with the weftwise rows of heddles and mounted for movement in timed relation with weftwise shifting of the warp strands.

9. In a weaving machine for making triaxial fabrics and having a plurality of elongate heddles arranged in weftwise rows for guiding warp strands, means for shifting the warp strands weftwise during weaving, creel means for supplying warp strands for weaving and mounted above said rows of heddles for rotation about a generally vertical axis in timed relation with weftwise shifting of the warp strands, and means for guiding warp strands passing from said creel means to said heddles along substantially constant length paths, the improvement wherein said warp strand guiding means comprises a plurality of elongate flexible tubular warp strand guides through which the warp strands extend, said tubular guides having entry end portions mounted on said creel means for rotation therewith and having exit end portions arranged in weftwise rows substantially aligned with the weftwise rows of heddles and mounted for movement in timed relation with weftwise shifting of the warp strands.

10. A weaving machine according to claim 9 wherein each of said tubular guides comprises helically wound wire means defining abutting coils for substantially enclosing warp strands extending therethrough.

11. A weaving machine according to claim 9 wherein each of said tubular guides has a length greater than the longest straight-line distance between its respective ends.

12. A weaving machine according to claim 9 wherein said warp strand guiding means further comprises a plurality of mounting means each for engaging said exit end portions of a plurality of said tubular guides, means for engaging said mounting means and defining a closed path of travel having parallel weftwise runs substantially parallel to said rows of heddles, and drive means for moving said mounting means about said closed path of travel in timed relation with weftwise shifting of the warp strands.

13. In a method of making triaxial fabrics in which a plurality of warp strands supplied from a rotating creel are delivered along constant length paths to be guidingly received in warp strand guide openings extending through nose portions of elongate heddles arranged in weftwise rows and moved weftwise by shifting of the heddles, the improvement in the delivering of warp strands to the heddles which comprises guidingly confining warp strands to a curvilinear path throughout at least a major portion of the path of travel of the warp strands from the creel to the heddles.

14. A method according to claim 13 wherein the guidingly confining of warp strands comprises bundling a plurality of the warp strands together for passage along a common curvilinear path.

15. A method according to claim 13 wherein the guidingly confining of warp strands comprises enclosing a lengthwise portion of each warp strand within a guiding tube.

* * * * *

UNITED STATES PATENT AND TRADEMARK OFFICE

CERTIFICATE OF CORRECTION

PATENT NO. : 4,020,876

DATED : May 3, 1977

INVENTOR(S) : Franklin L. Townsend and Robert L. Govig

It is certified that error appears in the above-identified patent and that said Letters Patent are hereby corrected as shown below:

Column 4, Line 68, "mounting" should be --mounted--.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*